US011315517B2

(12) United States Patent
Watanabe

(10) Patent No.: US 11,315,517 B2
(45) Date of Patent: Apr. 26, 2022

(54) DATA DRIVER AND DISPLAY APPARATUS THAT REDUCES DETERIORATION OF IMAGE QUALITY DUE TO DECREASE IN PIXEL CHARGING RATE DURING SUPPLY OF GRADATION VOLTAGE SIGNAL

(71) Applicant: LAPIS SEMICONDUCTOR CO., LTD, Yokohama (JP)

(72) Inventor: Keita Watanabe, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 0 days.

(21) Appl. No.: 16/922,519

(22) Filed: Jul. 7, 2020

(65) Prior Publication Data

US 2021/0012741 A1 Jan. 14, 2021

(30) Foreign Application Priority Data

Jul. 11, 2019 (JP) ..... JP2019-129199

(51) Int. Cl.
*G09G 3/36* (2006.01)

(52) U.S. Cl.
CPC ... *G09G 3/3688* (2013.01); *G09G 2310/0291* (2013.01); *G09G 2310/08* (2013.01); *G09G 2340/16* (2013.01)

(58) Field of Classification Search
CPC combination set(s) only.
See application file for complete search history.

(56) References Cited

U.S. PATENT DOCUMENTS 8,542,183 B2 9/2013 Nose et al.
2007/0171171 A1* 7/2007 Hector ..... G09G 3/20 345/98
2012/0162185 A1 6/2012 Park et al.
(Continued)

FOREIGN PATENT DOCUMENTS

JP H07318898 A 12/1995
JP 2003-122309 A 4/2003
JP 2007521520 A 8/2007
(Continued)

OTHER PUBLICATIONS

Japanese Notice of Rejection dated Apr. 14, 2020, Japanese Application No. 2019-129199, 5 pgs.
(Continued)

*Primary Examiner* — Ram A Mistry
(74) *Attorney, Agent, or Firm* — Volentine, Whitt & Francos, PLLC

(57) ABSTRACT

A modulated data signal is generated so as to change such that a length of a data period indicative of a timing of writing of the gradation voltage signal to each of the pixel portions becomes a length according to a distance from the data driver to each of the pixel portions. The timing control unit writes a video data signal to a memory at a timing according to a data period of the video data signal. The timing control unit reads the video data signal from the memory at a timing according to a period as a result of correction of a data period of the modulated data signal on the basis of a difference between an average value of lengths of the data periods of the video data signals and an average value of lengths of the data periods of the modulated data signals.

8 Claims, 9 Drawing Sheets

(56) References Cited

U.S. PATENT DOCUMENTS

| | | | | |
|---|---|---|---|---|
| 2018/0182355 | A1* | 6/2018 | Kobayashi | G09G 5/10 |
| 2018/0330655 | A1 | 11/2018 | Tsuchi et al. | |

FOREIGN PATENT DOCUMENTS

| | | | |
|---|---|---|---|
| JP | 2012042575 | A | 3/2012 |
| JP | 2018106165 | A | 7/2018 |
| JP | 2018189942 | A | 11/2018 |

OTHER PUBLICATIONS

Japanese Office Action dated May 18, 2021, Japanese Application No. 2020-129056, 5 pgs.
English translation of Japanese Office Action, 5 pgs.

* cited by examiner

DATA DRIVER AND DISPLAY APPARATUS THAT REDUCES DETERIORATION OF IMAGE QUALITY DUE TO DECREASE IN PIXEL CHARGING RATE DURING SUPPLY OF GRADATION VOLTAGE SIGNAL

CROSS-REFERENCE TO RELATED APPLICATION

This application is based upon and claims the benefit of priority from the prior Japanese Patent Application No. 2019-129199 filed on Jul. 11, 2019, the entire contents of which are incorporated herein by reference.

BACKGROUND

1. Technical Field

The present invention relates to a data driver and a display apparatus.

2. Description of the Related Art

There has been employed an active matrix driving method as a driving method of a display device, such as a liquid crystal display device and an organic Electro Luminescence (EL). A display apparatus with the active matrix driving method includes a display panel configured by a semiconductor substrate in which pixel portions and pixel switches are disposed in a matrix. On/off of the pixel switch is controlled by a gate signal and a gradation voltage signal corresponding to a video data signal is supplied to the pixel portion when the pixel switch turns on to control luminance of each pixel portion, and thus display is performed. A gate driver supplies the gate signal to a gate line, and a data driver supplies a data signal via a data line.

As the display apparatus used for a TV and a monitor, a demand for a large-screen display apparatus with high resolution, such as a 4K panel (pixel column: 3840×RGB, pixel row: 2160) and a 8K panel (pixel column that is twice the pixel column of the 4K panel and the pixel row that is twice the pixel row of the 4K panel), has been increasing. For example, a standard size of the 4K panel is diagonal of 65 inches, and a standard size of the 8K panel is diagonal of 80 inches. For the large screen and the high resolution of the display panel, an amount of video data increases. In association with this, a selection period of the gate signal output from the gate driver (a pulse width of the gate signal) shortens. On the other hand, a load capacitance of the data lines of the display panel that need to be driven by the data drivers increases, and a driving period per pixel driven by the data driver (a data period during which the gradation voltage signal is supplied to the data line) also shortens corresponding to the selection period of the gate signal. Additionally, a distance of a transmission path for the video data signal supplied from a display controller to each data driver also increases.

When the load capacitance of the data line increases and the driving period (data period) shortens, the gradation voltage signal supplied from the data driver changes its signal waveform according to a position on the data line of a supply destination. For example, among the plurality of positions on the data lines, on a position on the data line where a distance from the data driver in one direction (for example, a vertical direction) is relatively close (hereinafter referred to as a data line near end), a signal hardly has a slow rising of the signal waveform. On the other hand, among the plurality of positions on the data lines, the gradation voltage signal increases a slow to a position on the data line where the distance from the data driver in one direction (for example, the vertical direction) is relatively far (hereinafter referred to as a data line far end), and as a result, a charging rate of a pixel electrode decreases. Accordingly, luminance difference at the same gradation occurs in the pixel columns in the data line direction and image quality deterioration, such as unevenness in luminance, occurs.

To solve the decrease in charging rate of the pixel electrode, a display apparatus that modulates a pulse width of a gate signal and a driving period (data period) of a gradation voltage signal and averages pixel charging rates has been proposed (for example, JP-A-2003-122309). In this display apparatus, a control circuit supplies a video data signal to modulate a length of a driving period (data period) according to a distance from a data driver to the data driver. Additionally, the control circuit supplies a gate signal to modulate the pulse width of the gate signal according to the modulation of the length of the driving period (data period) to a gate driver.

SUMMARY

In the large-screen display apparatus, a distance between the control circuit (for example, the display controller) and each driver is long. In view of this, there may be a case where the video data signals are transmitted as a high-speed serial signal according to the number of transmission paths from the control circuit to the respective drivers. As in JP-A-2003-122309, in transmission of the modulation signal from the control circuit to each driver, to increase one data period at the data line far end in one frame period during which data rewriting by one screen is performed, one data period at the data line near end needs to be shortened. For example, to halve the one data period at the data line near end, a transmission frequency of the video data signal needs to be increased twice. When an increasing rate of the transmission frequency of the video data signal is large, it is necessary to enhance performance, that is, change a component to an expensive component, such that the component of the transmission path handles the high frequency. In view of this, a cost of the entire system increases. Further, a change in circuit configuration corresponding to the increase in frequency occurs also in the control circuit itself. Since the transmission frequencies of the video data signals of the 4K panel and the 8K panel are already high frequencies of gigahertz order, further increasing the transmission frequencies of the video data signals is not easy.

Therefore, to reduce the increase in transmission frequency between the control circuit and each driver, it is considered that the data timing is modulated such that the serialized video data signal VDS is transmitted at a constant cycle from the control circuit to the data driver, and one data period at the data line far end is increased and one data period at the data line near end is shortened by the data driver. However, to modulate the data timing by the data driver in this manner, a length of a writing period for one frame when data supplied from the control circuit is written to a memory inside the data driver differs from a length of a reading period for one frame when data is read from the memory on the basis of the modulated data timing. This caused a problem of possibly failing to smoothly write and read data.

The present invention has been made in consideration of the problem, and its objectives is to provide a data driver that reduces deterioration of an image quality due to decrease in pixel charging rate during supply of a gradation voltage signal without an increase in transmission frequency in transmission of a video data signal from a display controller to the data driver and allows smooth writing and reading of data to/from a memory in the data driver.

According to the present invention, a data driver that is connected to a display panel including a plurality of data lines, a plurality of gate lines and pixel portions, the pixel portions being disposed at respective intersecting portions of the plurality of data lines and the plurality of gate lines, and is supplied with video data signals formed of a series of a plurality of pieces of video data corresponding to the plurality of respective gate lines, the data driver being configured to supply gradation voltage signals corresponding to the video data signals to the plurality of data lines, the data driver comprising: a modulated data signal generating unit configured to generate a modulated data signal on the basis of the video data signal, the modulated data signal changing such that a length of a data period indicative of a writing period of the gradation voltage signal to each of the pixel portions becomes a length according to a distance from the data driver to each of the pixel portions; a timing control unit configured to write the video data signal to a memory at a timing according to a data period of the video data signal, the timing control unit being configured to read the video data signal from the memory at a timing according to a period as a result of correction of a data period of the modulated data signal on the basis of a difference between an average value of lengths of the data periods of the video data signals and an average value of lengths of the data periods of the modulated data signals; and an output unit configured to convert the video data signal read from the memory into the gradation voltage signal and output the gradation voltage signal to the data line.

According to the present invention, A display apparatus comprising: a display panel that includes a plurality of data lines, a plurality of gate lines, pixel switches and pixel portions, the pixel switches and the pixel portions being disposed at respective intersecting portions of the plurality of data lines and the plurality of gate lines; and a display controller configured to generate video data signals serialized at a constant cycle for every predetermined number of the data lines among the plurality of data lines; a gate driver configured to supply gate signals to the plurality of gate lines in a predetermined order in one frame period during the one frame period, the gate signals having pulse widths corresponding to selection periods during which the pixel switches are controlled to be on and according to cycles of gate timing signals that change the cycles, the one frame period corresponding to a rewriting period of one screen with the video data signals; and a plurality of data drivers disposed for every the predetermined number of the data lines, the plurality of data drivers being configured to receive a supply of the serialized video data signals from the display controller, the plurality of data drivers being configured to generate modulated data signals that change data periods in the one frame period, the plurality of data drivers being configured to supply gradation voltage signals corresponding to the respective pieces of video data produced by parallel conversion of the serialized video data signals to the predetermined number of respective data lines at every data period of the modulated data signal on the basis of the modulated data signals, wherein the plurality of data drivers each include: a memory configured to temporarily store the video data signal supplied from the display controller; a modulated data signal generating unit configured to generate the modulated data signal on the basis of the video data signal, the modulated data signal changing such that a length of a data period indicative of writing of the gradation voltage signal to each of the pixel portions becomes a length according to a distance from the data driver to each of the pixel portions; a timing control unit configured to write the video data signal to the memory at a timing according to a data period of the video data signal, the timing control unit being configured to read the video data signal from the memory at a timing according to a period as a result of correction of the data period of the modulated data signal on the basis of a difference between an average value of lengths of the data periods of the video data signals and an average value of lengths of the data periods of the modulated data signals; and an output unit configured to convert the video data signal read from the memory into the gradation voltage signal and output the gradation voltage signal to the data line.

With the display apparatus according to the present invention, while an increase in transmission frequency and deterioration of an image quality are reduced, data can be smoothly written to and read from the memory inside the data driver.

BRIEF DESCRIPTION OF THE DRAWINGS

Features of the present invention will be described below with reference to the accompanying drawings.

DETAILED DESCRIPTION

Figure 1:
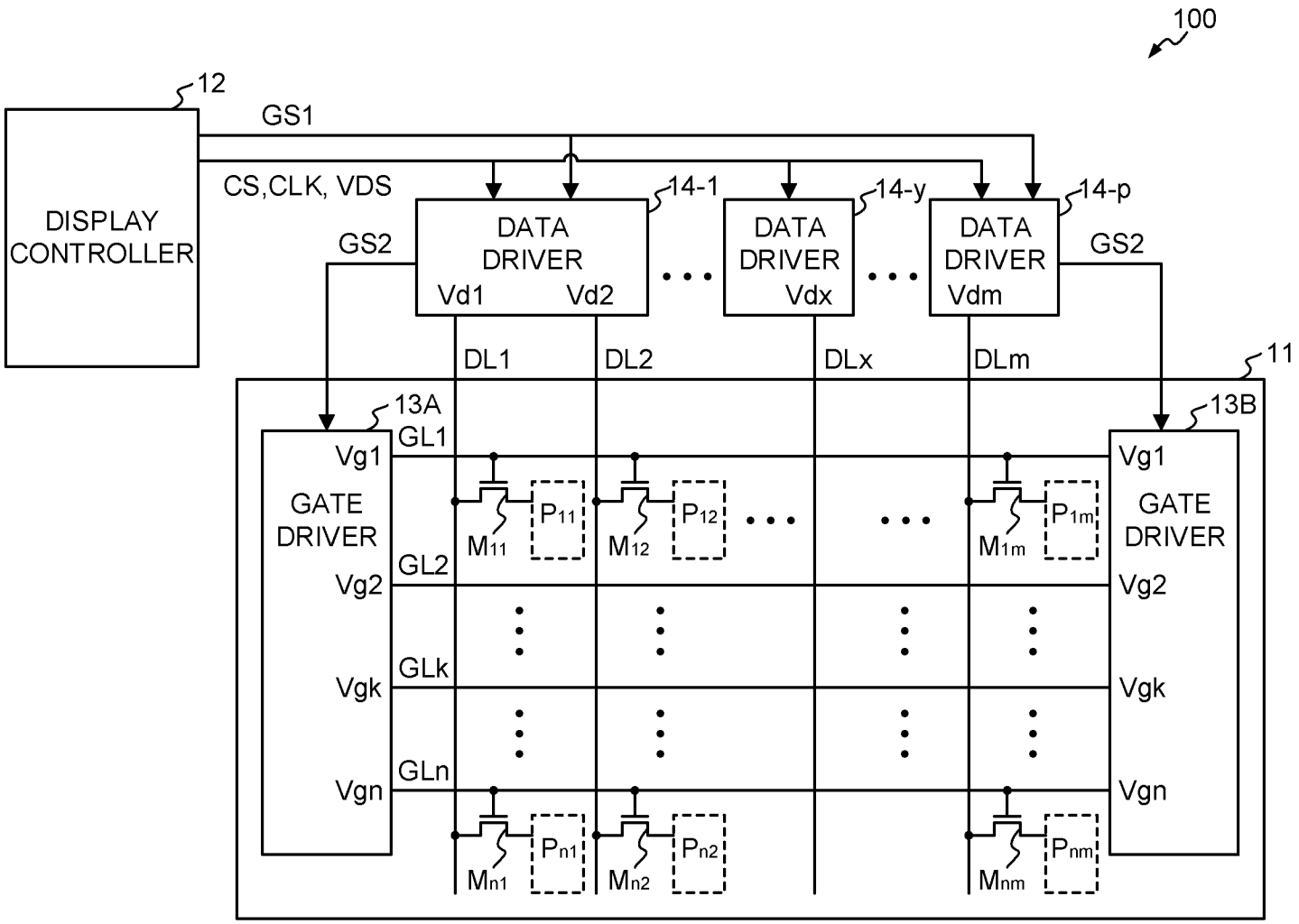
FIG. 1 is a block diagram illustrating a configuration of a display apparatus of an embodiment.

Preferred embodiments of the present invention will be described in detail below. Note that same reference numerals are given to substantially identical or equivalent parts in the description in the following embodiments and the accompanying drawings.

FIG. 1 is a block diagram illustrating a configuration of a display apparatus 100 of this embodiment. The display apparatus 100 is, for example, a liquid crystal display device with an active matrix driving method. The display apparatus 100 includes a display panel 11, a display controller 12, gate drivers 13A and 13B, and data drivers 14-1 to 14-*p*.

The display panel 11 is configured by a semiconductor substrate in which a plurality of pixel portions $P_{11}$ to $P_{nm}$ and pixel switches $M_{11}$ to $M_{nm}$ (n and m are natural numbers of two or more) are arranged in a matrix. The display panel 11 includes n pieces of gate lines GL1 to GLn and m pieces of data lines DL1 to DLm disposed to intersect with the gate lines GL1 to GLn. Note that, in the following description, among the n pieces of the gate lines GL1 to GLn, any given one gate line may be described as a gate line GLk, and among the m pieces of the data lines DL1 to DLm, any given one data line may be described as a data line DLx. The pixel portions $P_{11}$ to $P_{nm}$ and the pixel switches $M_{11}$ to $M_{nm}$ are disposed at intersecting portions of the gate lines GL1 to GLn and the data lines DL1 to DLm.

The pixel switches $M_{11}$ to $M_{nm}$ are controlled to be on or off according to the gate signals Vg1 to Vgn supplied from the gate drivers 13A and 13B.

The pixel portions $P_{11}$ to $P_{nm}$ receive supplies of gradation voltage signals Vd1 to Vdm corresponding to video data from the data drivers 14-1 to 14-*p*. When the respective pixel switches $M_{11}$ to $M_{nm}$ are on, the gradation voltage signals Vd1 to Vdm are supplied to respective pixel electrodes of the pixel portions $P_{11}$ to $P_{nm}$, and thus the respective pixel electrodes are charged. Luminance of the pixel portions $P_{11}$ to $P_{nm}$ is controlled according to the gradation voltage signals Vd1 to Vdm in the respective pixel electrodes of the pixel portions $P_{11}$ to $P_{nm}$, and thus display is performed. Note that, in the following description, among the gradation voltage signals Vd1 to Vdm, any given one gradation voltage signal may be denoted as Vdx.

When the display apparatus 100 is a liquid crystal display device, the pixel portions $P_{11}$ to $P_{nm}$ each include a transparent electrode connected to the data line via the pixel switch and a liquid crystal sealed between a semiconductor substrate and a counter substrate, which is disposed opposed to the semiconductor substrate and includes one transparent electrode on its entire surface. Transmittance of the liquid crystals change according to an electric potential difference between the gradation voltage signals Vd1 to Vdm supplied to the pixel portions $P_{11}$ to $P_{nm}$ and counter substrate voltages for a backlight inside the display apparatus, and thus display is performed.

The display controller 12 generates a clock signal CLK at a constant cycle of clock pulses (hereinafter referred to as a clock cycle). Then, the display controller 12 supplies the video data signals VDS to the data drivers 14-1 to 14-*p* according to a clock timing of the clock signal CLK. The video data signal VDS is configured as video data serialized according to the number of transmission paths for each of the predetermined number of data lines.

Additionally, the display controller 12 adds a control signal CS including various kinds of settings to the video data signal VDS. The clock signal CLK is formed, for example, by an embedded clock method. The display controller 12 supplies the video data signals VDS, the control signals CS, and the clock signals CLK to the respective data drivers 14-1 to 14-*p* as integrated serial signals for display control of the respective pieces of video data VD.

Additionally, among the data drivers 14-1 to 14-*p*, the display controller 12 supplies a gate timing signal GS1 to the data drivers 14-1 and 14-*p* on both ends, which are disposed at positions close to the gate drivers 13A and 13B. The gate timing signal GS1 is a timing signal at a constant cycle.

The gate drivers 13A and 13B receive a supply of gate timing signals GS2 having a modulation cycle from the data drivers 14-1 and 14-*p*. The gate drivers 13A and 13B supply gate signals Vg1 to Vgn produced by modulating pulse widths of the gate signals, that is, selection periods of the gate signals, to the gate lines GL1 to GLn on the basis of the gate timing signals GS2. By supplying the gate signals Vg1 to Vgn, the respective pixel portions $P_{11}$ to $P_{nm}$ are selected in the pixel row. Then, the data drivers 14-1 to 14-*p* supply the data signals Vd1 to Vdm to the selected pixel portions, and thus the data signals Vd1 to Vdm are written to the pixel electrodes.

The data drivers 14-1 to 14-*p* are disposed for every predetermined number of data lines into which the data lines DL1 to DLm are divided. For example, when one data driver has 960 outputs and the display panel includes one data line per pixel column, the data lines are driven by 12 data drivers in the 4K panel and 24 data drivers in the 8K panel. The data drivers 14-1 to 14-*p* receive the supply of the serial signals, which are the integrated control signals CS, clock signals CLK, and video data signals VDS, by the respective different transmission paths from the display controller 12. When the transmission paths between the display controller 12 and each data driver is one pair (two pieces), the video data VD and the control signals CS for the number of outputs of the data driver are supplied as a serialized differential signal in one data period.

The respective data drivers 14-1 to 14-*p* generate the video data VD produced by parallel converting the serialized video data signal VDS and generates modulated data signals that change their cycles in one frame period corresponding to a rewriting period of one screen. For example, the cycle of the modulated data signal changes in stages in the one frame period. Based on the data timings (data periods) of the modulated data signals, the gradation voltage signals Vd1 to Vdm corresponding to the respective pieces of video data VD are supplied to the pixel portions $P_{11}$ to $P_{nm}$ via the data lines DL1 to DLm. The modulated data signals are set such that the timings (data periods) become different according to the distances on the data lines from the respective data drivers to the pixel portions as the write destinations. Specifically, in one frame period, one data period during which the gradation voltage signal is supplied to the pixel portion at the data line near end close to the data driver is set to be short, and one data period during which the gradation voltage signal is supplied to the pixel portion at the data line far end far from the data driver is set to be long.

Here, in this specification, the pixel portion at the data line near end means the pixel portion disposed at a position on the data line where a distance from the data driver in one direction (the vertical direction in the example of FIG. 1) is relatively close among the plurality of positions on the data lines.

Further, the pixel portion at the data line far end means the pixel portion disposed at a position on the data line where the distance from the data driver in one direction (the vertical direction in the example of FIG. 1) is relatively far among the plurality of positions on the data lines.

The data driver 14-1, which is positioned at the left end portion among the data drivers 14-1 to 14-*p*, is connected to the gate driver 13A via a signal line. Additionally, the data driver 14-*p*, which is positioned at the right end portion, is connected to the gate driver 13B via a signal line. The data drivers 14-1 and 14-*p* generate the gate timing signals GS2 having a cycle (timing and a pulse interval) corresponding to a data timing of the modulated data signal based on the gate timing signal GS1 by receiving the supply of the gate timing signal GS1 at the constant cycle from the display controller 12 and supply them to the respective gate drivers 13A and 13B. The gate timing signals GS2 are set such that the selection timings of the gate signals supplied from the gate drivers 13A and 13B to the respective gate lines become different timings according to the distances from the data drivers 14-1 and 14-*p* on the data lines. Specifically, in one frame period, the selection period of the gate signal to the pixel portion at the data line near end close to the data driver is set to be short, and the selection period of the gate signal to the pixel portion at the data line far end far from the data driver is set to be long. The respective modulation cycles of the modulated data signals and the gate timing signals GS2 are not independently set, but timing settings in which correlation is mutually maintained are made. In the following description, the data drivers 14-1 and 14-*p* are also collectively referred to as a specific driver.

Note that, in FIG. 1, control signals (not illustrated) for timing adjustment between the data drivers 14-1 to 14-*p* may be supplied, for example, from the specific drivers 14-1 and 14-*p* to the data driver except for the specific drivers.

Further, in FIG. 1, the gate timing signals GS1 supplied from the display controller 12 may be replaced by setting information of the gate timing signal GS1, and this setting information may be transmitted to at least the specific data drivers 14-1 and 14-*p* among the data drivers 14-1 to 14-*p* as serial signals integrated with the video data signal VDS, the control signal CS, and the clock signal CLK.

In FIG. 1, the gate timing signals GS2 generated by the specific drivers 14-1 and 14-*p* may be constituted of a plurality of gate timing signal groups, and the respective gate timing signal groups may be supplied to the gate drivers 13A and 13B. Then, the gate drivers 13A and 13B may be configured such that the selection timings of the gate signals supplied to the respective gate lines are generated by timing composition of the plurality of supplied gate timing signal groups.

Additionally, in FIG. 1, as the display controller 12, the existing display controller that supplies signals at a predetermined cycle with a configuration in which serial signals at a predetermined cycle including the video data signals VDS and the gate timing signals GS1 at a predetermined cycle are output can be utilized. In the display apparatus in FIG. 1, the data drivers 14-1 to 14-*p* each modulate a pulse width (data period) of a data line output signal (gradation voltage signal), and the specific drivers 14-1 and 14-*p* modulate the pulse widths (data periods) of the data line output signals (gradation voltage signals) and modulate pulse widths (selection periods) of the gate signals.

In the configuration of FIG. 1, the modulated data signals and the gate timing signals GS2 that maintain the predetermined timing correlation are generated in the specific drivers 14-1 and 14-*p* where the distances between the display panel 11 and the gate drivers 13A and 13B are close. In view of this, timing shift due to an influence from the signal transmission path is less likely to occur in the gate line of the display panel 11 and the gate signal and the data line output signal (gradation voltage signal) supplied to the data line, and therefore high-quality display can be achieved.

Figure 2:
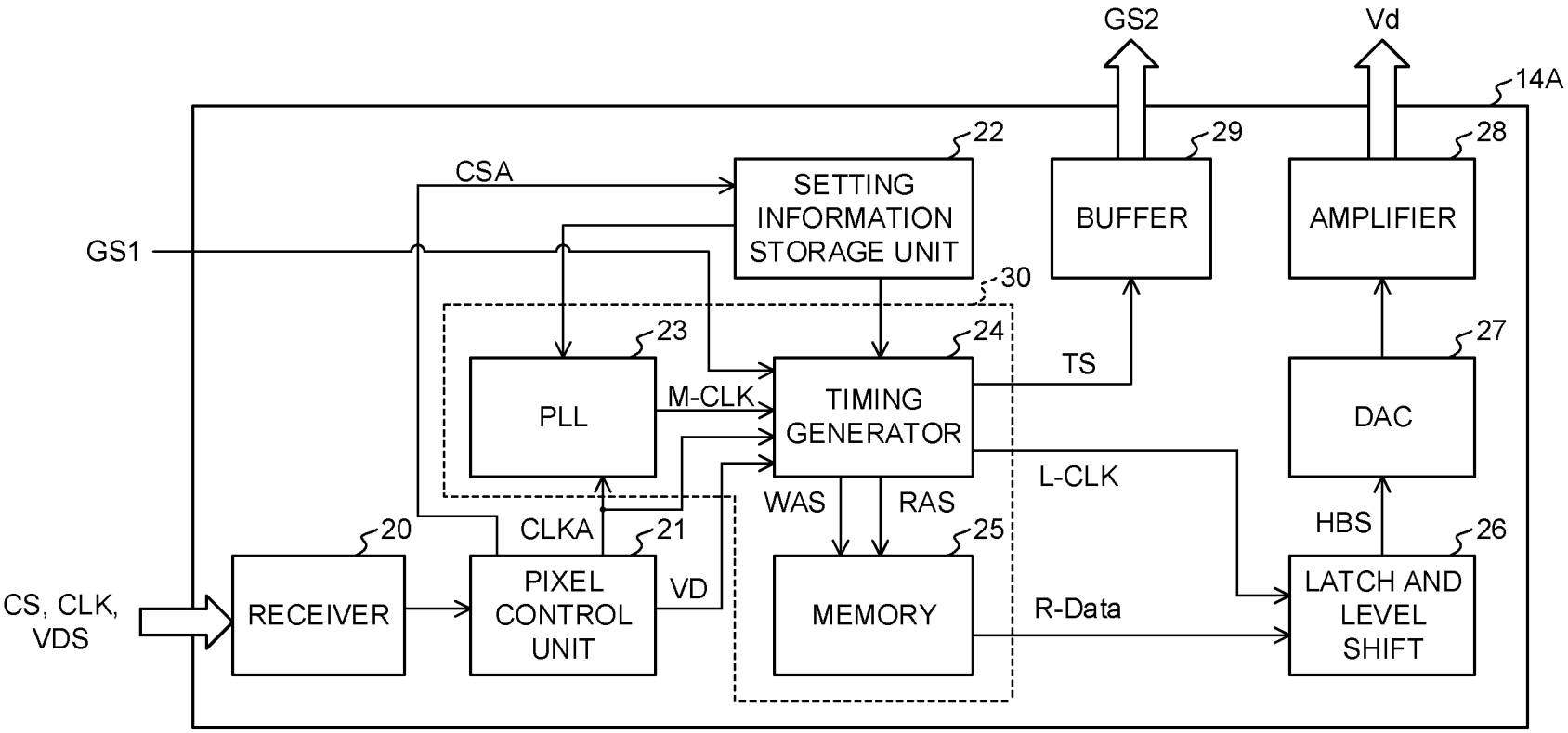
FIG. 2 is a block diagram illustrating a configuration of main blocks of a specific driver among a plurality of data drivers.

FIG. 2 is a block diagram illustrating a configuration of main blocks related to control of output timings (data periods) of the gradation voltage signals Vd corresponding to the respective pieces of video data VD output from the predetermined number of output ends and output timings of the gate signals and the pulse widths with the gate timing signals GS2 in a driver IC 14A constituting the data drivers 14-1 and 14-*p* as the specific drivers.

The driver IC 14A includes a receiver 20, a pixel control unit 21, a setting information storage unit 22, a Phase Locked Loop (PLL) 23, a timing generator 24, a memory 25, a latch and level shift circuit 26, a Digital to Analog Converter (DAC) 27, an amplifier 28, and a buffer 29. A timing control unit 30 includes the PLL 23, the timing generator 24, and the memory 25. The serial signal (the control signal CS, the video data signal VDS, and the clock signal CLK) and the gate timing signal GS1 output from the display controller 12 are input to the driver IC 14A.

The receiver 20 is a receiving device that receives the high-speed serial signal (namely, the control signal CS, the video data signal VDS, and the clock signal CLK) output from the display controller 12. The control signal CS, the video data signal VDS, and the clock signal CLK on which high-speed serial transmission has been performed are parallel converted by the pixel control unit 21 via the receiver 20 and are separated into the individual signals.

The pixel control unit 21 extracts a clock signal CLKA at a constant frequency from the embedded clock signal CLK and supplies it to the PLL 23 and the timing generator 24. Further, the pixel control unit 21 extracts a control signal CSA from the serialized control signal CS and supplies it to the setting information storage unit 22. The control signal CSA includes setting information for the PLL 23 and the timing generator 24. Moreover, the pixel control unit 21 converts the video data signal VDS supplied as serial data into the video data VD as parallel data and supplies it to the timing generator 24.

The setting information storage unit 22 stores the setting information to control operations of the PLL 23 and the timing generator 24. Note that the setting values stored by the setting information storage unit 22 are appropriately changeable according to an adjustment from the outside. The setting information storage unit 22, for example, stores a modulation curve to generate a modulation clock signal M-CLK where a frequency periodically changes from the clock signal CLKA at the constant frequency.

Figure 3:
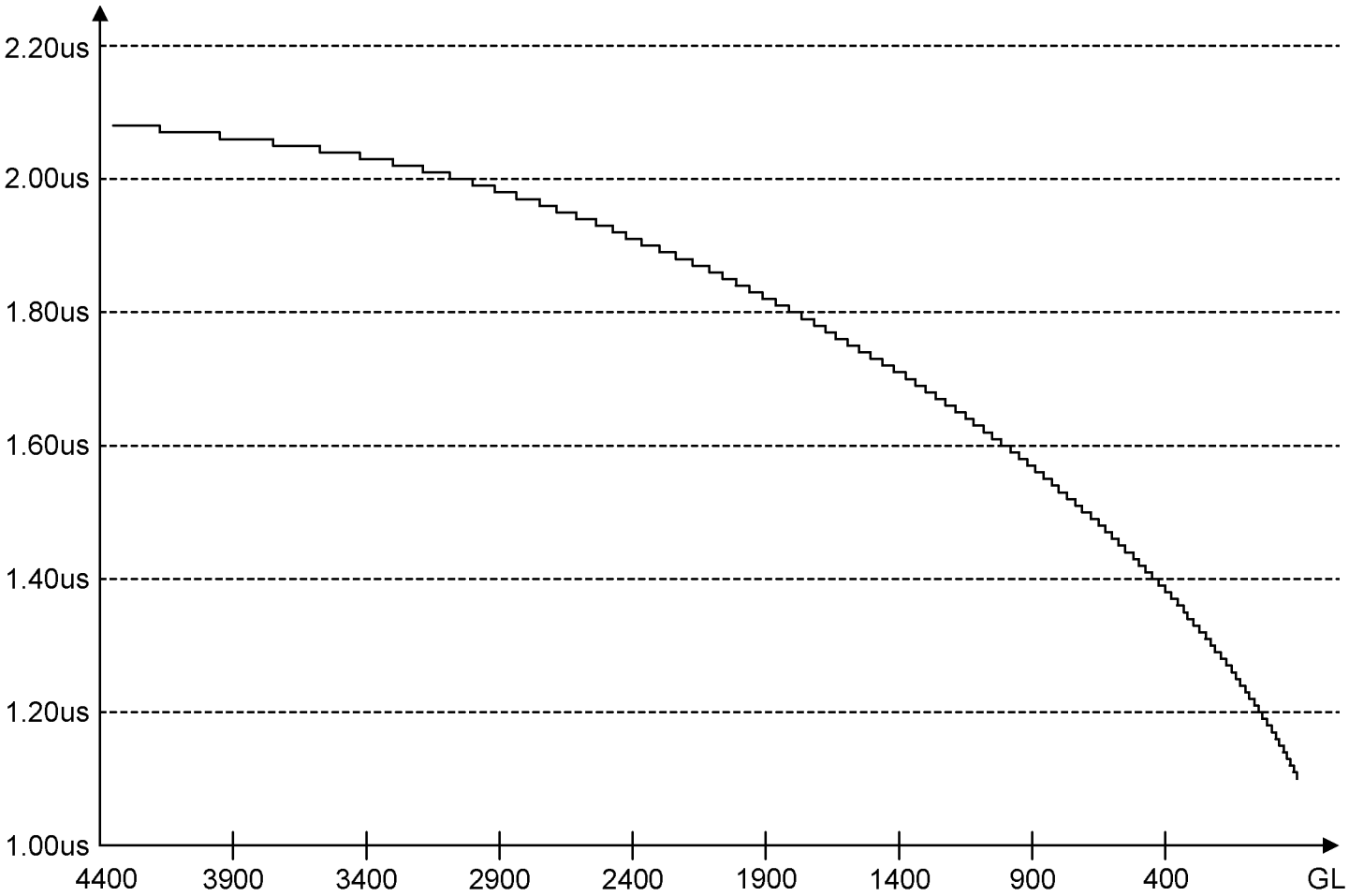
FIG. 3 is a drawing schematically illustrating a modulation curve stored by a setting information storage unit.

FIG. 3 is a drawing schematically illustrating the modulation curve stored by the setting information storage unit 22. The display apparatus 100 of this embodiment modulates the data timing such that the data period of the video data VD supplied to the pixel at the position where the distance from the data drivers 14-1 to 14-*p* is far becomes long and the data period of the video data VD supplied to the pixel at the position where the distance from the data drivers 14-1 to 14-*p* is close becomes short. In view of this, for example, assuming that the number of gate lines is n=4320, a waveform of the modulation curve becomes a waveform in which data periods of data supplied to gate lines around a gate line GL4320 where the distance from the data drivers 14-1 to 14-*p* is the farthest become long, and the data period becomes short as the distance from the data drivers 14-1 to 14-*p* to the gate line becomes close.

With reference to FIG. 2 again, the PLL 23 performs frequency modulation on the clock signal CLKA on the basis of the modulation curve stored in the setting information storage unit 22 and generates the modulation clock signal M-CLK. The PLL 23 supplies the generated modulation clock signal M-CLK to the timing generator 24.

The timing generator 24 receives the modulation clock signal M-CLK from the PLL 23. The timing generator 24 generates the modulated data signal that changes its cycle in one frame period on the basis of the modulation clock signal M-CLK. The timing generator 24 generates a read clock signal indicative of a timing to read data from the memory 25 on the basis of data timing (data period) of the generated modulated data signal. Additionally, the timing generator 24 generates a latch clock signal L-CLK based on the data timing of the modulated data signal and supplies it to the latch and level shift circuit 26.

Further, the timing generator 24 supplies a write address signal WAS that instructs data writing to the memory 25 on the basis of the video data VD and the clock signal CLKA at the constant frequency supplied from the pixel control unit 21. The write address signal WAS includes the video data VD for each gate line and information on a write clock indicative of a timing of data writing.

Additionally, the timing generator 24 receives the gate timing signal GS1, generates a gate timing signal TS having a cycle (a timing and a pulse interval) corresponding to the data timing of the modulated data signal on the basis of the gate timing signal GS1 and outputs it. The gate timing signal TS is amplified by the buffer 29 and output from the driver IC 14A as the gate timing signal GS2.

The memory 25 is a one-frame memory including a storage area storing the video data VD by one frame. The video data VD is written to the memory 25 according to the supply of the write address signal WAS from the timing generator 24 to the memory 25. The video data VD is read from the memory 25 according to the supply of a read address signal RAS from the timing generator 24 to the memory 25. The video data VD read from the memory 25 is supplied to the latch and level shift circuit 26 as read data R-Data.

Note that, in this embodiment, one horizontal synchronization period in writing of the video data VD to the memory 25 (hereinafter referred to as a write 1H period) differs from one horizontal scanning period in reading of the identical video data VD from the memory 25 (hereinafter referred to as a read 1H period). Here, when the length of the one frame period of the data writing differs from the length of one frame period of the data reading, the data writing and reading cannot be smoothly performed, possibly causing a memory failure. In view of this, the timing generator 24 of this embodiment corrects the read address signal RAS such that the difference between the period of data writing by one frame to the memory 25 and the period of data reading by one frame from the memory 25 decreases. This will be described with reference to FIG. 3 to FIG. 5.

Figure 4:
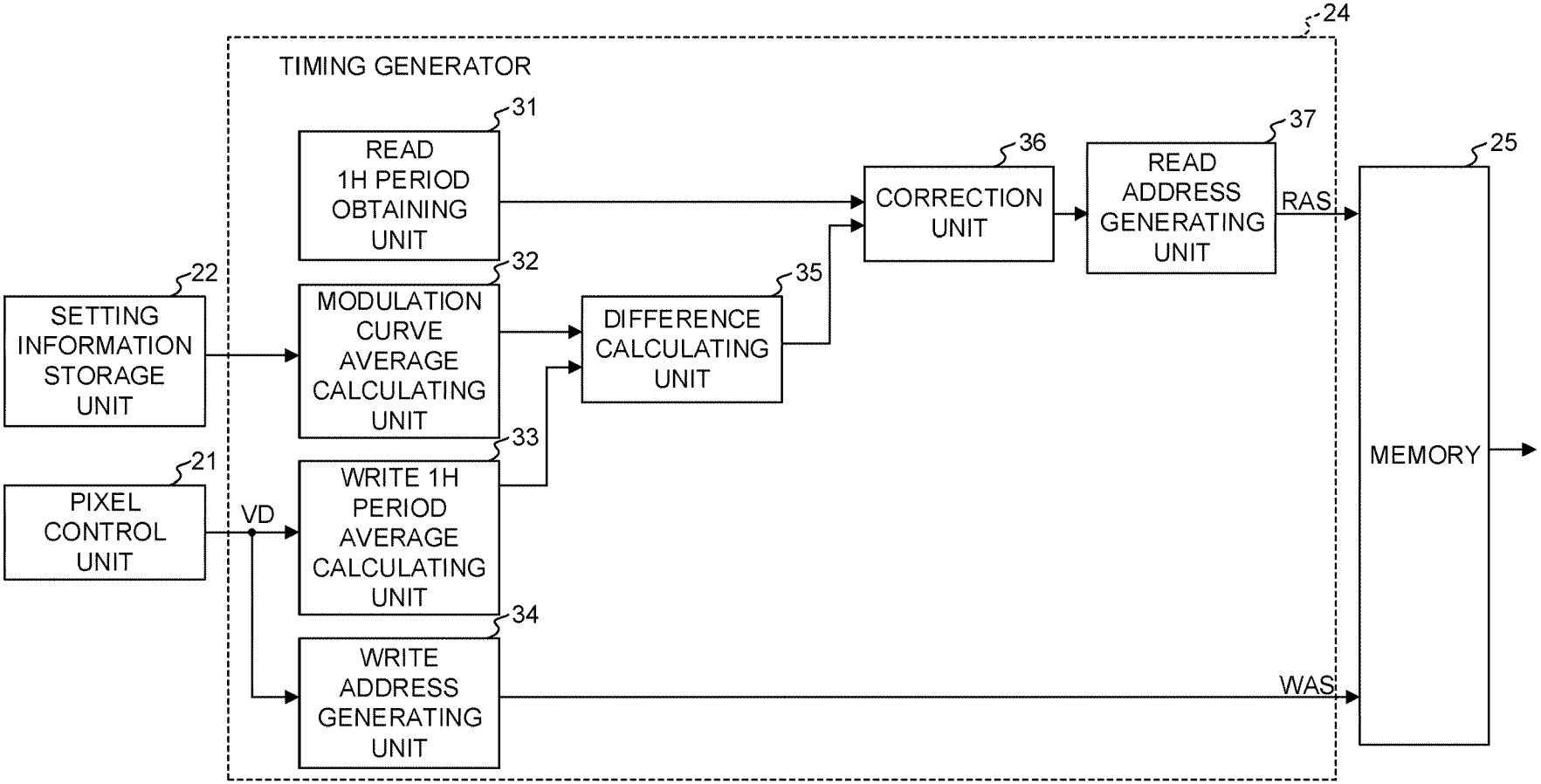
FIG. 4 is a block diagram illustrating a configuration of function blocks of a timing generator.

FIG. 4 is a block diagram illustrating a configuration of function blocks of the timing generator 24. The timing generator 24 includes a read 1H period obtaining unit 31, a modulation curve average calculating unit 32, a write 1H period average calculating unit 33, a write address generating unit 34, a difference calculating unit 35, a correction unit 36, and a read address generating unit 37.

The read 1H period obtaining unit 31 obtains one horizontal scanning period of a horizontal synchronization signal corresponding to the reading of the video data VD from the memory 25 (namely, the read 1H period) on the basis of the modulation clock signal M-CLK supplied from the PLL 23. The read 1H period is a period corresponding to each data period of the modulated data signal.

The modulation curve average calculating unit 32 calculates an average value of the lengths of the data periods for each one line shown by the modulation curve on the basis of this modulation curve stored in the setting information storage unit 22.

The write 1H period average calculating unit 33 samples the write 1H periods on the basis of the video data VD supplied from the pixel control unit 21 and calculates an average value of the write 1H periods.

The write address generating unit 34 generates the write address signal WAS on the basis of the video data VD supplied from the pixel control unit 21 and the modulation clock signal M-CLK supplied from the PLL 23.

The difference calculating unit 35 calculates a difference between the average value of the lengths of the data periods calculated by the modulation curve average calculating unit 32 and the average value of the write 1H periods calculated by the write 1H period average calculating unit 33.

The correction unit 36 corrects the read 1H period generated by the read 1H period obtaining unit 31 on the basis of the difference calculated by the difference calculating unit 35 and supplies the correction result to the read address generating unit 37.

The read address generating unit 37 generates the read address signal RAS based on the read 1H period corrected by the correction unit 36.

The write address signal WAS is supplied from the write address generating unit 34 to the memory 25. Thus, the video data VD in every write 1H period indicated by the write address signal WAS is sequentially written to the memory 25. The read address signal RAS is supplied from the read address generating unit 37 to the memory 25. Thus, the video data VD in every read 1H period indicated by the read address signal RAS is read from the memory 25.

The timing generator 24 corrects the horizontal scanning period of the read address signal RAS so as to decrease the difference between the length of the one frame period of the data writing and the length of the one frame period of the data reading by the operations of the respective units.

Figure 5:
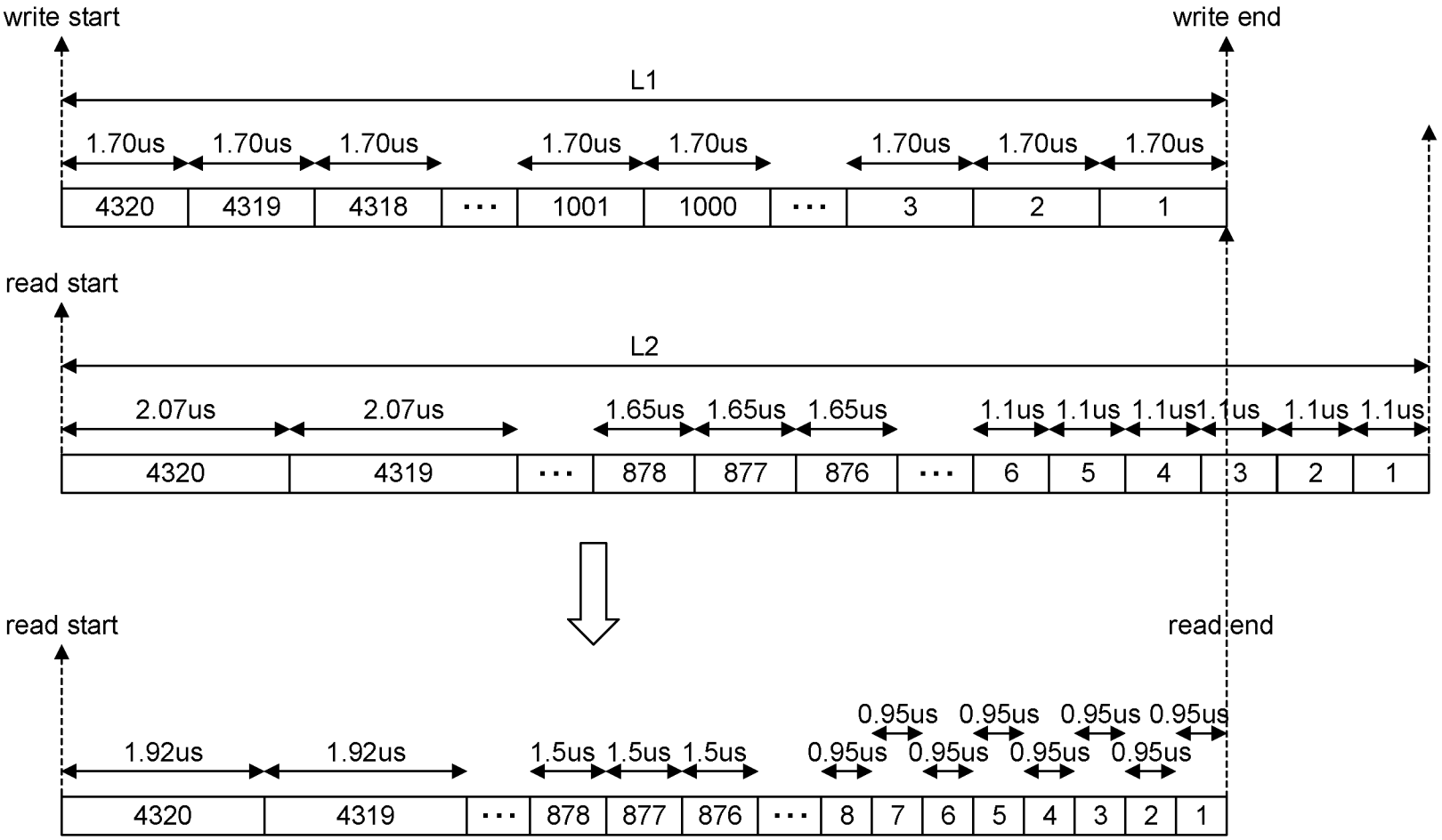
FIG. 5 is a drawing schematically illustrating an adjustment of a read address signal by the timing generator.

FIG. 5 is a drawing schematically illustrating the adjustment of the read address signal RAS by the timing generator 24. Here, FIG. 5 illustrates assuming that the number of gate lines GL is n=4320 and indicating the video data in every one horizontal scanning period using a number of the gate line GL corresponding to each supply destination (that is, 1, 2, . . . , 4320 in the order that the distance from the data drivers 14-1 to **14-*p*** is close).

For example, the write 1H period included in the write address signal WAS is constant (for example, 1.70 μs) and the length of the write 1H period for one frame becomes a length L1, which is indicated in the upper stage of FIG. 5.

In contrast to this, the read 1H period before correction is long in the period corresponding to the gate line far from the data drivers 14-1 to **14-*p* and is short as the distance from the data drivers 14-1 to 14-*p* to the gate line becomes close. For example, as indicated in the middle stage of FIG. 5, the read 1H period corresponding to GL4320 and GL4319, which are gate lines where the distances from the data drivers 14-1 to 14-*p* are far, is 2.07 μs, the read 1H period corresponding to GL878, GL877, and G876, which are gate lines where the distances from the data drivers 14-1 to 14-*p* are middle, is 1.65 μs, and the read 1H period corresponding to GL6 to GL1, which are gate lines where the distances from the data drivers 14-1 to 14-*p* are close, is 1.1 μs. The length of the read 1H period for one frame found by adding these values becomes a length L2 as indicated in the middle stage of FIG. 5**.

As described above, the timing generator 24 calculates the difference between the average value of the write 1H periods (namely, 1.70 μs) and the length of each read 1H period, and corrects the length of the read 1H period on the basis of the calculated difference. For example, assume that a length found by subtracting 0.15 μs from the length of the read 1H period before correction is the length of the read 1H period after correction. The read 1H period corresponding to GL4320 and GL4319, which are gate lines where the distances from the data drivers 14-1 to **14-*p* are far, is 1.92 μs, the read 1H period corresponding to GL878, GL877, and GL876, which are gate lines where the distances from the data drivers 14-1 to 14-*p* are middle, is 1.5 μs, and the read 1H period corresponding to GL6 to GL1, which are gate lines where the distances from the data drivers 14-1 to 14-*p* are close, is 0.95 μs. As a result, as indicated in the lower stage of FIG. 5, the total length of the read 1H period for one frame becomes a length same as the length L1** of the write 1H period for one frame.

Thus, the difference between the length of the writing period and the length of the reading period for one frame decreases, and the lengths of the respective periods become equal. Accordingly, the data writing and reading can be smoothly performed using the memory in the data driver.

With reference to FIG. 2 again, the latch and level shift circuit 26 latches the video data R-Data according to the latch clock signal L-CLK that determines the output timing of the gradation voltage signal from the driver IC 14A, level-converts a high voltage bit signal (that is, a binary high voltage digital signal) according to an output power supply voltage, and outputs a high-voltage bit signal HBS.

The DAC 27 receives the input of the high-voltage bit signal HBS, selects a gradation level voltage corresponding to the high-voltage bit signal HBS (that is, digital-analog conversion), and supplies it to the amplifier 28 as an analog gradation voltage signal.

The amplifier 28 amplifies the gradation voltage signal selected by the DAC 27 and outputs it to the data line. Note that, in FIG. 2, the respective blocks of the memory 25, the latch and level shift circuit 26, the DAC 27, and the amplifier 28 are configured as a circuit group corresponding to the number of outputs from the driver IC 14A.

Note that the example in which the setting information storage unit 22 disposed inside the driver IC 14A stores the setting information including the modulation curve has been described. However, different from this, a configuration that appropriately supplies various kinds of setting information from the outside of the data driver may be used. For example, a setting storage device including, for example, an Electrically Erasable Programmable Read-Only Memory (EEPROM) may be disposed outside the driver IC 14A, and the setting storage device may store change setting information to change the settings of the modulation of the pulse width of the gate timing signal GS2 and the modulation of the data period of the gradation voltage signal Vd.

Additionally, while FIG. 2 has been described as the configuration of the specific drivers 14-1 and **14-*p*, a data driver except for the specific drivers 14-1 and 14-*p* may be configured to similarly to the configuration of FIG. 2. In the case, the data driver except for the specific drivers is set so as not to input the gate timing signal GS1 and not to output the gate timing signal GS2. For example, the data driver having the configuration of FIG. 2 may have a setting that stops operations of a gate timing adjustment circuit (not illustrated) in the timing generator 24 and the buffer 29 on the basis of the control signal CSA transmitted from the display controller 12 or the setting information from the outside. This allows the driver IC 14**A to perform switching between the specific driver and another data driver by the supplied setting information, thereby ensuring increasing versatility of the data drivers.

Moreover, to supply the control signal for timing adjustment from the specific drivers 14-1 and **14-*p* to the data driver except for the specific drivers, the specific drivers 14-1 and 14-*p* may have a configuration that outputs this control signal from the buffer 29. The data driver except for the specific drivers that receive the control signal may have a configuration that receives the control signal instead of the gate timing signal GS1**.

Figure 6A:
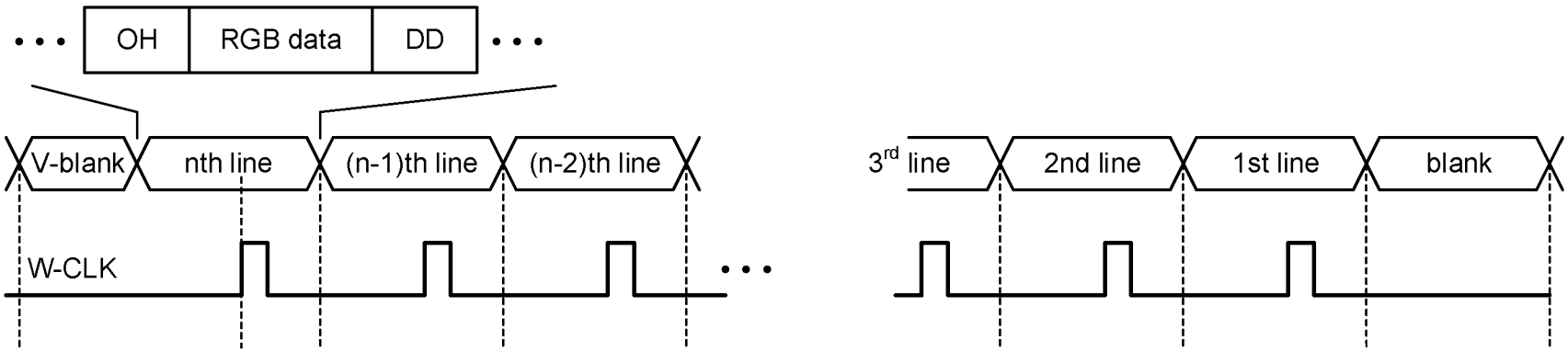
FIG. 6A is a timing chart illustrating a video data signal corresponding to a data line DLx and a write timing of the video data signal to a memory.

FIG. 6A illustrates a timing chart of the one frame period of the video data VD and internal signals corresponding to the output to the data line DLx in one data driver 14 among the data drivers 14-1 to **14-*p*. The upper stage of FIG. 6A shows the video data VD corresponding to the gate line GLn and the data line DLx in the serialized video data signal VDS. The middle stage of FIG. 6A shows the data periods of the respective pieces of video data VD during which the serialized video data signal VDS is parallel converted. The pieces of video data VD corresponding to the selection periods of the respective gate lines are sequentially transmitted in the order of the gate lines GLn, GL(n−1), . . . , GL1 (that is, the order from the side far from the data driver to the side close to the data driver). The lower stage of FIG. 6A illustrates a write clock signal W-CLK that controls the timing of writing the parallel converted video data VD to the memory 25. Note that, in the following description, one of the data drivers 14-1 to 14-*p* is simply referred to as the data driver 14**.

As illustrating in the upper stage of FIG. 6A, each piece of the video data VD includes an overhead OH that includes, for example, a start pulse and config data, RGB data as the actual data corresponding to the number of outputs from the data driver 14, and dummy data DD. In the video data signal VDS, the large number of pieces of video data VD according to the number of outputs from the data driver 14 are serialized. For example, in a case where the video data signals VDS are transmitted in the form of differential signals by one pair (two pieces) of transmission paths, the video data signal VDS is configured by including the video data VD by the number of outputs from the data driver 14 in the one data period illustrated in the middle stage of FIG. 6A. Additionally, the cycle of the video data signal VDS is a fraction of the number of outputs in the one data period. Accordingly, the clock signal CLK embedded in the video data signal VDS also has a considerably high frequency.

As illustrated in the middle stage of FIG. 6A, blank periods (indicated as V-blank and blank in the drawing) are provided at the start and the end of the video data signal VDS. The control signal CS including various kinds of setting information is included into the blank period. The display controller 12 supplies the control signal CS to the data driver 14 as a series of the serial signals integrated with the video data signal VDS.

The timing generator 24 sequentially writes the respective pieces of video data VD parallel converted according to the number of outputs from the data driver 14 to the memory 25 on the basis of the write address signal WAS including the write clock signal W-CLK at the constant cycle.

Figure 6B:
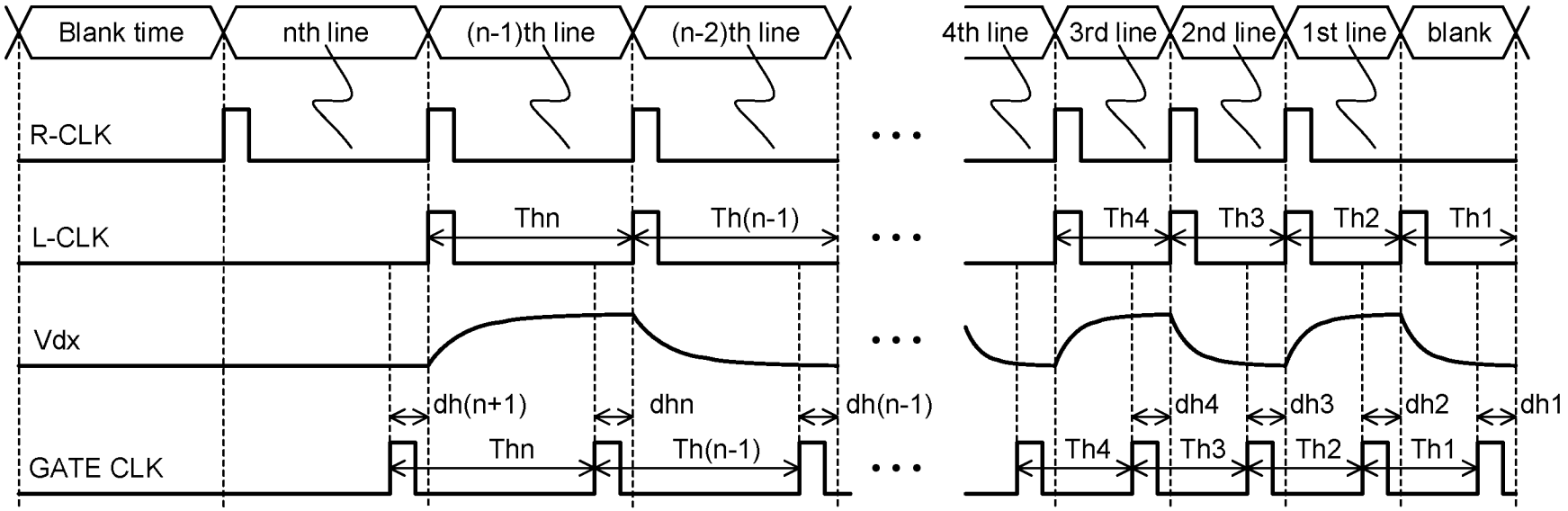
FIG. 6B is a timing chart illustrating clock timings of a read clock signal and a latch clock signal and a second gate timing signal.

Similar to FIG. 6A, FIG. 6B illustrates a timing chart of the one frame period of the video data VD and internal signals corresponding to the output to the data line DLx in one data driver 14 among the data drivers 14-1 to **14-*p*. Here, the data periods of the respective pieces of video data VD, a read clock signal R-CLK that controls the timing of reading the video data VD from the memory 25, and the clock timing of the latch clock signal L-CLK are illustrated. FIG. 6B also illustrates the gradation voltage signal Vdx output from the data driver 14** based on the latch clock signal L-CLK and the gate CLK indicative of each timing of the gate signal sequentially output to each gate line.

As illustrated in FIG. 6B, the respective pieces of video data VD read from the memory 25 are read in the order same as the writing order to the memory 25 on the basis of the read clock signal R-CLK. That is, the video data VD corresponding to the selection period of each gate line is sequentially read from the memory 25 in the order of the gate lines GLn, GL(n−1), . . . , GL1 (the order from the far side to the close side from the data driver 14). Here, in the read clock signal R-CLK, the clock timing is modulated such that the data period of the video data VD written to the pixel row far from the data driver 14 is longer than that of the write clock signal W-CLK and the data period of the video data VD written to the pixel row close to the data driver 14 is shorter than that of the write clock signal W-CLK. As described above, by the correction process of the horizontal scanning period of the read address signal RAS performed by the timing generator 24, the adjustment is performed such that the data period of the data writing matches the data period of the data reading for one frame.

The latch clock signal L-CLK that determines the timing (one data period) of output from the data driver 14 to the data line is configured as a clock signal, for example, that is delayed from the read clock signal R-CLK by one data period. On the basis of the latch clock signal L-CLK, the digital-analog converted gradation voltage signal Vdx is output from the data driver 14 to the data line DLx. In FIG. 6B, each data period during which the gradation voltage signal Vdx is output is generated at a timing (Thn, Th(n−1), . . . , Th1) from a rising edge of the latch clock signal L-CLK until the next rising edge. That is, one data period of the data signal Vdx supplied to the pixel on the side close to the data driver 14 (data line near end) is set to be short, and one data period of the gradation voltage signal Vdx supplied to the pixel on the side far from the data driver 14 (data line far end) is set to be long. Note that an output waveform of the gradation voltage signal Vdx of FIG. 6B is an illustration of an example of a waveform in which the maximum gradation voltages and the minimum gradation voltages are output in alternation for convenience of illustration.

The gate CLK (the gate timing signal TS in FIG. 2) is generated on the basis of the gate timing signal GS1 and the modulated data signal by the timing generator 24. The gate CLK is generated as a clock signal at a clock timing shifted by a predetermined period (dh(n+1), dhn, dh(n−1), . . . , dh1) from the rising edge (the timing of one data period) of the latch clock signal L-CLK. On the basis of the clock timings of the gate CLK, the selection periods (namely, the pulse widths) of the gate signals Vgn, . . . Vgk . . . , Vg1 corresponding to the gate lines GLn, . . . GLk . . . , GL1 are set. On the basis of the clock timing of the gate CLK, the gate timing signals GS2 according to driving circuits of the gate drivers 13A and 13B are generated by the buffer 29.

Note that there may be a case where the large-screen display apparatus performs pre-charge on the gate line to increase the charging rate of the gradation voltage signal to the pixel electrode. To perform pre-charge on the gate line, prior to the selection period of the gate signal to select the gradation voltage signal for charging to the pixel electrode, the selection period of the gate signal starts from the plurality of selection periods before. That is, a period with the length over the plurality of selection periods is set to the pulse width of the gate signal. For example, the gate timing signal GS2 may be generated so as to be the gate signal that expands the pulse width from the plurality of selection periods before to a selection period Thk for the selection period Thk of the gate signal Vgk set in the gate CLK of FIG. 6B.

Figure 7:
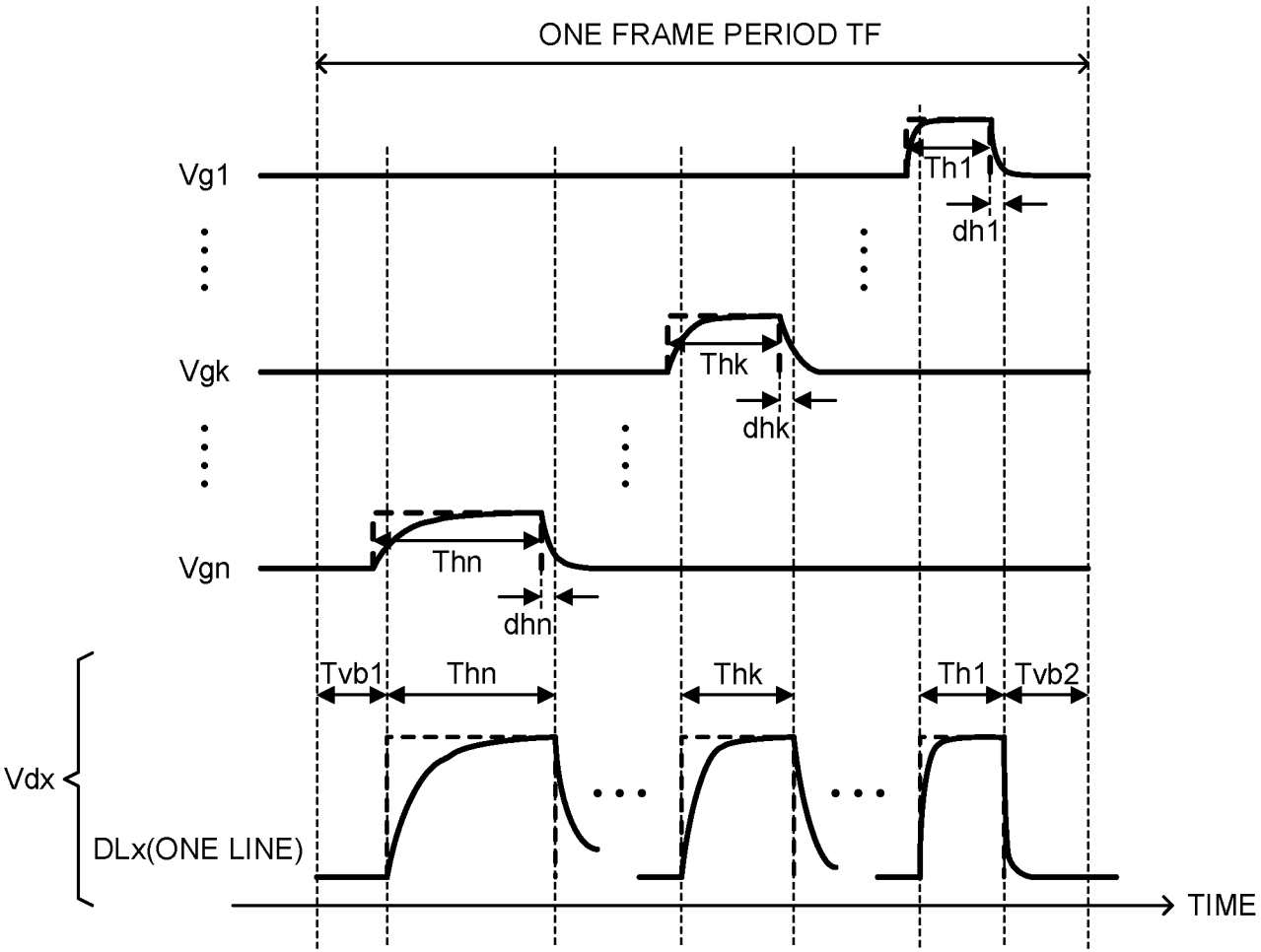
FIG. 7 is a drawing illustrating signal waveforms of gate signals supplied to respective gate lines and a gradation voltage signal Vdx supplied to the data line DLx in one frame period.

FIG. 7 is a drawing illustrating a signal waveform of the gate signals Vg1, . . . Vgk . . . , Vgn output from the gate driver 13A or 13B of this embodiment to each gate line and the gradation voltage signal Vdx output from the data driver 14 to the data line DLx in one frame period. Note that, for convenience of explanation regarding signal delay, the gradation voltage signal Vdx is illustration of a signal waveform that changes from a gradation voltage at a low electric potential to a gradation voltage at a high electric potential in the one data period corresponding to the selection period (Th1, Thk, Thn) of the gate signal.

Here, regarding "one data period" as the period during which the gradation voltage signal Vdx is supplied, the one data period at the data line far end is denoted as Thn, and the one data period at the data line near end is denoted as Th1. Regarding one data period corresponding to the supply of the gradation voltage signal Vdx, each data period is set such that the one data period shortens at the data line near end and the one data period lengthens to the data line far end side.

Since an influence from an impedance to the data line is small at the data line near end, a slow rising of the signal waveform is small. Therefore, even when the one data period Th1 shortens, a voltage level of the gradation voltage signal Vdx output from the data driver 14 can be written to the pixel electrode at the data line near end as it is.

In contrast to this, the rising of the signal waveform becomes significantly slow at the data line far end due to a large influence from the data line impedance. However, since the one data period Thn is long, the gradation voltage signal Vdx can reach the voltage level at the output (that is, the voltage level of the gradation voltage signal Vdx output from the data driver 14), and this voltage level can be written to the pixel electrode at the data line far end. In view of this, the pixel charging rate in the data line direction dependent on the data line impedance can be uniformed in full-screen display at the same gradation.

On the other hand, the gate signals Vg1, . . . Vgn are set such that the pulse width (selection period) widens from the data line near end to the data line far end according to one data period of the gradation voltage signal Vdx. That is, the pulse width of the gate signal Vg1 to select the pixel at the data line near end is short, and the pulse width of the gate signal Vgn to select the pixel at the data line far end is long. In view of this, pixel charging rates of the identical gradation voltage signal to the pixels in the data line direction can be uniformized. Note that FIG. 7 illustrates an example in which the pulse widths of the gate signals are set to be equivalent to the one data periods. Here, as described above, for pre-charge of the gate signal, the pulse width of the gate signal may be expanded.

Moreover, the gate signals Vg1 to Vgn are sequentially output from the gate drivers 13A and 13B in the order from the data line far end to the data line near end, that is, in the order of Vgn, . . . , Vgk, . . . , Vg1. The gradation voltage signals Vdx each selected with the gate signals Vgn, . . . , Vgk, . . . , Vg1 are sequentially output to the data lines DLx.

Note that the output order of the gate signals Vg1 to Vgn can be set to be an order from the data line near end to the data line far end, which is the revere order of FIG. 7, that is, the order of Vg1, . . . , Vgk, . . . , Vgn. However, in this case, since the reading of the video data VD from the memory 25 is always performed after the writing of this video data VD to the memory 25, the timing of the read clock signal R-CLK to read the first video data VD from the memory 25 needs to be delayed for a predetermined period from the timing of the write clock signal W-CLK to take in the first video data VD to the memory 25. In this case, the timing generator 24 corrects the horizontal scanning period of the read address signal RAS using a curve reverse from the modulation curve illustrated in FIG. 3. This allows the data writing period and the data reading period to be equal for one frame.

Meanwhile, as illustrated in FIG. 7, when the gate signals are output in the order from Vgn, . . . , Vgk, . . . , Vg1, the cycle of the clock timing of the read clock signal R-CLK to read the video data VD is long immediately after the start of reading compared with the constant cycle of the clock timing of the write clock signal W-CLK to write this video data VD to the memory 25 and gradually shortens. In view of this, the reading of the first video data VD can be started at a timing slightly delayed from the writing of the first video data VD.

Additionally, in this embodiment, differences in timing dh1, . . . dhk . . . dhn between the data signal Vdx and the gate signals Vg1 to Vgn are adjusted according to the distances from the gate driver 13A or 13B. For example, since a timing at which the gate signal Vgn turns off (that is, changes from a high level to a low level) delays at the gate line far end, a timing difference dhn needs to be set large to avoid selecting the gradation voltage signal that should be selected at the next gate signal Vg(n−1) with the gate signal Vgn and so as not to cause false charging in the pixel electrode. Note that the timing differences dh1, . . . dhk . . . dhn may be variable according to the distance on the data line from the data driver 14.

Note that, in FIG. 7, the timing differences dh1, . . . dhk . . . dhn between the data signal Vdx and the gate signals Vg1 to Vgn are set by timing differences between end timings of the selection periods of the respective gate signals and end timings of the respective data periods of the data signal Vdx.

Figure 8:
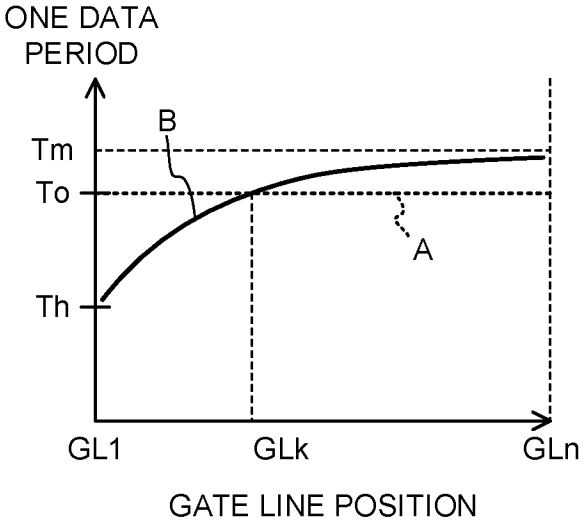
FIG. 8 is a drawing illustrating a correspondence relationship between one data period and a position of each gate line away from the data driver.

FIG. 8 is a drawing illustrating a correspondence relationship between one data period when the gradation voltage signal Vdx corresponding to the video data VD is written and the positions of the respective gate lines GL1, . . . , GLn from the data driver 14.

Different from the display apparatus 100 of this embodiment, in a case where the writing period of the gradation voltage signal Vdx is set to be constant regardless of the position of the gate line from the data driver, as indicated by the dashed line A, the length of the one data period becomes constant (a constant value To indicated in FIG. 8).

In contrast to this, in the display apparatus 100 of this embodiment, as indicated by the solid line B, the one data period and the gate selection period on the gate line GL1 side close to the data driver 14 are set to be short and the one data period and the gate selection period on the gate line GLn side far from the data driver 14 are set to be long. Note that the characteristic curve of the solid line B becomes a curved line dependent on an impedance (a product of a wiring resistance and a wiring capacity) of the data line corresponding to the gate line position from the data driver 14.

The display apparatus 100 of this embodiment changes the one data period from a minimum value Th to a maximum value Tm and perform setting such that the average value in the one frame period becomes close to To. For example, the timing generator 24 of this embodiment corrects the horizontal scanning period of the read address signal RAS as described above to adjust such that the average value of the cycles of the read clock signals R-CLK becomes equivalent to the average value of the cycles of the write clock signals W-CLK at the constant cycle. This minimizes a difference between write data W-Data written to the memory 25 and the read data R-Data, thereby ensuring reducing the capacity of the memory 25. Additionally, by the above-described control of the read clock signal R-CLK, as illustrated in FIG. 6A and FIG. 6B, a total period of the writing and a total period of the reading are both controlled so as to each fall within one frame period.

As described above, in the display apparatus 100 of this embodiment, according to the distances from the data drivers 14-1 to 14-*p* to the pixels as targets for writing the video data VD, the gradation voltage signals Vd1 to Vdm whose one data periods are short at the data line near end and whose one data periods are long at the data line far end are generated, and are applied to the data lines DL1 to DLm. Additionally, the data drivers 14-1 and 14-*p* as the specific drivers generate the gate timing signals GS2 that change the selection periods of the gate lines so as to match the one data periods of the gradation voltage signals according to the distances from the data drivers to the pixels as the target for writing the video data. The gate drivers that receive the gate timing signals GS2 generate the gate line signals Vg1 to Vgn that change the selection periods of the gate lines according to the distances from the data drivers to the pixels as the targets for writing the video data and apply them to the gate lines GL1 to GLn.

In the configuration, the display controller 12 only needs to transmit the video data signal VDS, the clock signal CLK, and the control signal CS, which are serialized and integrated at the constant cycle, and the gate timing signals GS1 at the constant cycle to the data drivers 14-1 to 14-*p*. In view of this, a substantial increase in transmission frequency due to the transmission of the modulation signal does not occur in the signal transmission between the display controller 12 and the data drivers 14-1 to 14-*p*. Additionally, a component of the transmission path needs not to be changed to enhance the performance according to the increase in transmission frequency.

Further, in the display apparatus 100 of this embodiment, the data drivers 14-1 and 14-*p* generate the gate timing signals GS2, in addition to the generation and output of the data signal Vdx. This eliminates the change in configuration of the display controller 12 (TCON-IC31), and the change can be aggregated to the configuration of the data drivers 14-1 to 14-*p*.

Accordingly, the display apparatus according to the present invention allows reducing the deterioration of image quality while an increase in apparatus scale is reduced.

Additionally, in the display apparatus 100 of this embodiment, the timing generator 24 corrects the horizontal scanning period of the read address signal RAS such that the average of the one horizontal periods of the data writing to the memory 25 in the data driver matches the average of the one horizontal periods of the data reading. Since the adjustment is thus performed such that the length of the period of the data writing matches the length of the period of the data reading by one frame, the data writing to the memory 25 and the data reading from the memory 25 can be smoothly performed. Additionally, this eliminates the need for a large-capacity memory adapted for the difference between the timing of data writing and the timing of data reading, and therefore reduction in chip size is possible.

Therefore, the display apparatus according to the present invention allows smoothly writing and reading data to/from the memory in the data driver while the increase in chip size is reduced.

Figure 9:
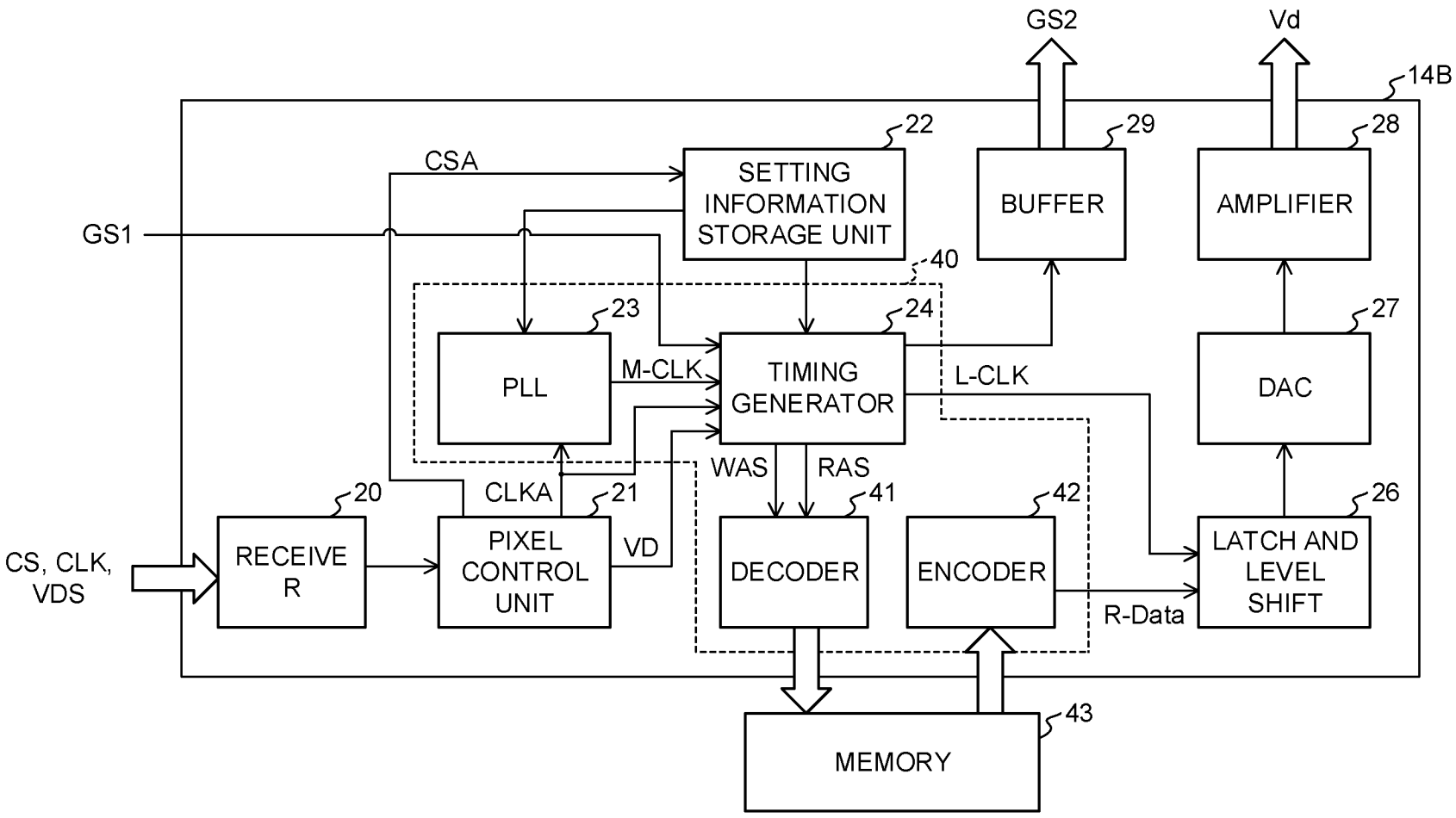
FIG. 9 is a block diagram illustrating a configuration of main blocks of a specific driver according to a modification in which the memory is disposed outside a driver IC.

Note that, different from the embodiment, the memory may be disposed outside, not the inside of the driver IC. FIG. 9 is a block diagram illustrating a configuration of main blocks of such a driver IC 14B.

The driver IC 14B includes a decoder 41 and an encoder 42. A timing control unit 40 includes the PLL 23, the timing generator 24, the decoder 41, and the encoder 42.

A memory 43 is disposed outside the driver IC 14B. Note that the memory 43 has a function similar to that of the memory 25 illustrated in FIG. 2 except that the memory 43 is disposed outside the driver IC 14B.

The decoder 41 is disposed between the timing generator 24 and the memory 43. The decoder 41 decodes the write address signal WAS and the read address signal RAS output from the timing generator 24 to signals according to the number of write data buses connecting between the memory 43 and the driver IC 14B and the transmission frequency and transmits it to the memory 43.

The encoder 42 is disposed between the memory 43 and the latch and level shift circuit 26. The encoder 42 encodes data read from the memory 43 according to the read address signal RAS on the basis of the signal according to the number of read data buses connecting between the memory 43 and the driver IC 14B and the transmission frequency, and transmits it to the latch and level shift circuit 26 as read data R-Data.

Note that configurations and operations of the function blocks except for the decoder 41 and the encoder 42 are similar to those of the respective function blocks of the embodiment.

Thus, even when the memory 43 is disposed separately from the driver IC 14B, the effects similar to that of the embodiment can be obtained.

With such a configuration, the memory 43 can be achieved by a process finer than the driver IC 14B. Therefore, in the case of a comparatively large memory capacity, a system cost can be reduced compared with a case where the memory is incorporated into the driver IC as in the embodiment.

Note that the present invention is not limited to the embodiment. For example, while the case where the display apparatus 100 is the liquid crystal display device has been described in the embodiment, different from this, the display apparatus 100 may be an organic Electro Luminescence (EL) display apparatus. With the use of the organic EL display apparatus as the display apparatus 100, the pixel portions $P_{11}$ to $P_{nm}$ each include an organic EL device and a thin film transistor that controls a current flowing through the organic EL device. The thin film transistors control the currents flowing through the organic EL devices according to the gradation voltage signals Vd1 to Vdm supplied to the pixel portions $P_{11}$ to $P_{nm}$ and emission luminance of the organic EL devices changes according to the currents, and thus display is performed. The application of the present invention to the organic EL display apparatus also allows performing the display while reduced unevenness in luminance.

Moreover, the display panel 11 may be a collar Full High Definition (FHD) panel or may be the 4K panel or the 8K panel.

Additionally, in the embodiment, the configuration that the timing generator 24 corrects the read address signal RAS has been described as the example in which the length of the data reading period for one frame is longer than the length of the data writing period for one frame. However, the present invention is also applicable to a case where the length of the data reading period for one frame is shorter than the length of the data writing period for one frame. In this case as well, the difference value found by subtracting the average value of the lengths of the horizontal scanning periods of the write address signals WAS from the average value of the lengths of the data periods shown by the modulation curve, is subtracted from the length of the horizontal scanning period of the read address signal RAS and then the horizontal scanning period of the read address signal RAS is corrected. Thus, the length of the data reading period for one frame can be made equal to the length of the data writing period for one frame.

The embodiment has described the example in which the timing generator 24 corrects the read 1H period such that the period of data writing to the memory 25 by one frame matches the period of data reading from the memory 25 by one frame. However, the period of data writing needs not to strictly match the period of data reading. It is only necessary that the correction is performed such that at least the difference in length between these periods decreases.

It is understood that the foregoing description and accompanying drawings set forth the preferred embodiments of the present invention at the present time. Various modifications, additions and alternative designs will, of course, become apparent to those skilled in the art in light of the foregoing teachings without departing from the spirit and scope of the disclosed invention. Thus, it should be appreciated that the present invention is not limited to the disclosed Examples but may be practiced within the full scope of the appended claims.

What is claimed is:

1. A data driver that is connected to a display panel including a plurality of data lines, a plurality of gate lines and pixel portions, the pixel portions being disposed at respective intersecting portions of the plurality of data lines and the plurality of gate lines, and is supplied with video data signals formed of a series of a plurality of pieces of video data corresponding to the plurality of respective gate lines, the data driver being configured to supply gradation voltage signals respectively corresponding to each of the plurality of pieces of video data to the plurality of data lines, the data driver comprising:

a modulated data signal generating unit configured to generate a modulated data signal on the basis of the video data signal, the modulated data signal changing such that a length of a data period indicative of a writing period of the gradation voltage signal to each of the pixel portions becomes a length according to a distance from the data driver to each of the pixel portions;

a timing control unit configured to write the video data signal to a memory at a timing according to a data period of each of the plurality of pieces of video data, the timing control unit being configured to correct the length of each of the data periods of the modulated data signal by using a difference between an average value of lengths of the data periods of the video data signals and an average value of lengths of the data periods of the modulated data signals so as to read the video data signal from the memory at a timing corresponding to each length of the corrected data periods of the modulated data signal; and an output unit configured to convert the video data signal read from the memory into the gradation voltage signal and output the gradation voltage signal to the data line.

2. The data driver according to claim 1, wherein the timing control unit is configured to control the timing of reading the video data signal from the memory on the basis of a period obtained by subtracting a difference value from each of the data periods of the modulated data signals, the difference value are found by subtracting the average value of the lengths of the data periods of the plurality of pieces of video data from the average value of the lengths of the data periods of the modulated data signals.

3. The data driver according to claim 1, wherein the pixel portions are arranged in a matrix such that the plurality of gate lines correspond to respective horizontal scanning lines, and the timing control unit is configured to generate a write signal and a read signal, the write signal includes a horizontal scanning period according to the data period of the plurality of pieces of video data and indicates the timing of the writing of the video data signal to the memory, and the read signal includes a horizontal scanning period according to the data period of the modulated data signal and indicates the timing of reading the video data signal from the memory.

4. The data driver according to claim 3, wherein the timing control unit comprises:

a read horizontal scanning period obtaining unit configured to obtain each length of the horizontal scanning periods of the read signals;

a modulation period average calculating unit configured to calculate the average value of the lengths of the data periods of the modulated data signals;

a write address generating unit configured to generate the write signals;

a write horizontal scanning period average calculating unit configured to calculate an average value of the lengths of the horizontal scanning periods of the write signals;

a difference calculating unit configured to calculate a difference between the average value of the lengths of the data periods of the modulated data signals and the average value of the lengths of the horizontal scanning periods of the write signals; and a correction unit configured to correct the horizontal scanning periods of the read signals on the basis of the calculated difference.

5. The data driver according to claim 4, further comprising:

a storage unit that stores information on a modulation curve indicative of a change in the data period of the modulated data signal, wherein the modulation period average calculating unit is configured to calculate the average value of the lengths of the data periods of the modulated data signals on the basis of the information on the modulation curve.

6. The data driver according to claim 3, wherein the timing control circuit is configured to correct a horizontal scanning period of the read signal such that a length of a period of the horizontal scanning period for one frame of the write signal matches a length of a period of the horizontal scanning period for one frame of the read signal.

7. The data driver according to claim 1, wherein the output unit comprises:

a digital/analog conversion circuit configured to convert the video data signal read from the memory into the gradation voltage signal; and an amplifier circuit configured to amplify the gradation voltage signal and output to the data line.

8. A display apparatus comprising:

a display panel that includes a plurality of data lines, a plurality of gate lines, pixel switches and pixel portions, the pixel switches and the pixel portions being disposed at respective intersecting portions of the plurality of data lines and the plurality of gate lines; and a display controller configured to generate video data signals serialized at a constant cycle for every predetermined number of the data lines among the plurality of data lines;

a gate driver configured to supply gate signals to the plurality of gate lines in a predetermined order in one frame period during the one frame period, the gate signals having pulse widths corresponding to selection periods during which the pixel switches are controlled to be on and according to cycles of gate timing signals that change the cycles, the one frame period corresponding to a rewriting period of one screen with the video data signals; and a plurality of data drivers disposed for every the predetermined number of the data lines, the plurality of data drivers being configured to receive a supply of the serialized video data signals from the display controller, the plurality of data drivers being configured to generate modulated data signals that change data periods in the one frame period, the plurality of data drivers being configured to supply gradation voltage signals corresponding to the respective pieces of video data produced by parallel conversion of the serialized video data signals to the predetermined number of respective data lines at every data period of the modulated data signal on the basis of the modulated data signals, wherein the plurality of data drivers each comprising a memory configured to temporarily store the video data signal supplied from the display controller;

a modulated data signal generating unit configured to generate the modulated data signal on the basis of the video data signal, the modulated data signal changing such that a length of a data period indicative of writing of the gradation voltage signal to each of the pixel portions becomes a length according to a distance from the data driver to each of the pixel portions;

a timing control unit configured to write the video data signal to the memory at a timing according to a data period of each of the plurality of pieces of video data, the timing control unit being configured to read the video data signal from the memory at a timing which is derived from the data period of the modulated data signal and a difference between an average value of lengths of the data periods of the video data signals and an average value of lengths of the data periods of the modulated data signals; and an output unit configured to convert the video data signal read from the memory into the gradation voltage signal and output the gradation voltage signal to the data line.

* * * * *